US005245326A

United States Patent [19]

Zalph

[11] Patent Number: 5,245,326

[45] Date of Patent: Sep. 14, 1993

[54] CALIBRATION APPARATUS FOR BRIGHTNESS CONTROLS OF DIGITALLY OPERATED LIQUID CRYSTAL DISPLAY SYSTEM

[75] Inventor: Walter N. Zalph, Boca Raton, Fla.

[73] Assignee: International Business Machines Corp., Armonk, N.Y.

[21] Appl. No.: 911,424

[22] Filed: Jul. 10, 1992

Related U.S. Application Data

[63] Continuation-in-part of Ser. No. 747,217, Aug. 19, 1991, Pat. No. 5,206,633.

[51] Int. Cl.[5] ..... G09G 3/36

[52] U.S. Cl. ..... 345/92; 358/10; 345/89; 345/117

[58] Field of Search ..... 340/784 B1, 784 D1, 340/784 F, 793, 767, 812, 713, 715; 358/10, 139, 168, 236

[56] References Cited

U.S. PATENT DOCUMENTS

| | | | |
|---|---|---|---|
| 4,571,584 | 2/1986 | Suzuki | 340/784 |
| 4,746,970 | 5/1988 | Hosokawa et al. | 358/29 |
| 4,833,464 | 5/1989 | Di Santo et al. | 340/793 |
| 4,945,351 | 7/1990 | Nalman | 340/793 |
| 5,001,481 | 3/1991 | Lee | 341/136 |
| 5,030,947 | 7/1991 | Dieudonne et al. | 340/767 |
| 5,153,756 | 10/1992 | Ike | 340/713 |

FOREIGN PATENT DOCUMENTS

| | | | |
|---|---|---|---|
| 0313331 | 4/1989 | European Pat. Off. | 340/784 |
| 0420727 | 4/1991 | European Pat. Off. | 340/784 |
| 2237400 | 5/1991 | United Kingdom | 340/784 |

*Primary Examiner*—Alvin E. Oberley
*Assistant Examiner*—Gin Goon
*Attorney, Agent, or Firm*—Douglas R. McKechnie; Daniel E. McConnell

[57] ABSTRACT

A TFT LCD display has a PEL matrix in which the drain lines of the different TFTs are supplied with different drain voltages to achieve a preset number of gray scales. The different drain voltages are set during factory calibration through use of a test PEL having substantially the same characteristics as the PELs viewable by a user. The characteristics of the test PEL are first measured, the values of drain voltages for achieving the different gray scales are mathematically derived from the measurements, and such values are stored in the display system. The specific manner in which calibration is done is by measuring output voltages of a photodiode located next to the test PEL as a function of different drain voltage inputs and constructing a unique transmissivity versus drain voltage for the subject display. Calibration is accomplished by a factory tester or by a built-in calibration system.

8 Claims, 2 Drawing Sheets

CALIBRATION APPARATUS FOR BRIGHTNESS CONTROLS OF DIGITALLY OPERATED LIQUID CRYSTAL DISPLAY SYSTEM

RELATED APPLICATION

The current application is a continuation-in-part of application Ser. No. 07/747,217, U.S. Pat. No. 5,206,633, filed Aug. 19, 1991, by Walter N. Zalph, for "SELF CALIBRATING BRIGHTNESS CONTROLS FOR DIGITALLY OPERATED LIQUID CRYSTAL DISPLAY SYSTEM", and assigned to the same assignee. The disclosure of such application is hereby incorporated herein by reference.

BACKGROUND OF THE INVENTION

Liquid crystal display (LCD) systems are commonly formed with a matrix of picture elements or PELs each containing a TFT (thin film transistor) coupled with liquid crystal material that transmits light in accordance with control signals applied to the TFT. The transmissivity or apparent brightness of the PEL is a function of the polarization of the liquid crystal material which is a function of the magnitude of the drain voltage and of the time during which such voltage is applied in conjunction with a gate signal. After the control signals have been applied, the parasitic capacitance to the TFT temporarily stores a DC value which must be refreshed or recharged to maintain the desired transmissivity over a longer period of time.

With LCD monitors or displays, it is difficult to obtain many precise steps in the transmissivity between a PEL being fully "On" or "Off". By applying different levels or values of drain voltage, a given PEL can transmit different amounts of light and appear to a user to have different brightness levels or "gray scales". Traditional methods for achieving various gray scales include pulse width modulation (PWM) and pulse amplitude modulation (PAM). In PWM, a fixed drain voltage is applied for different periods of time determined by the pulse width. In PAM, different drain voltages are applied for the same amount of time (fixed pulse width). PAM is preferred for high end TFT LCD monitors. Using PAM, the average polarization of a PEL varies with the PEL's light transmission percentage (transmissivity) to produce gray toning. With PAM, PEL transmissivity is directly controlled by the analog value of the voltage applied to the PELs drain line while the PELs gate line is activated by a digital gate signal.

Current LCD manufacturing processes do not yield completely uniform or predictable ranges of PEL transmissivities versus applied PEL drain bias voltages for each LCD system. The basic shape of a transmissivity curve is well understood, but the absolute values thereof vary widely within the displays produced in a given manufacturing run. Human visual perception further complicates the situation because such perception "sees" gray scales in a logarithmic manner as opposed to a linear gradation. This means that to increase the number of gray scales by a factor "n" requires increases in contrast ratios of $(\sqrt{2})^n$ where the contrast ratio CR is the ratio of the maximum transmissivity to the minimum transmissivity.

The parent application identified above, is directed to testing and calibration apparatus that is incorporated into each display and allows each display to calibrate itself. Such feature is advantageous in systems where the components are subject to functional deterioration through aging, and each display can be readily calibrated as needed. However, it is possible that some LCD screen technologies (present or future) have transmissivity characteristics which vary in a manufacturing run but do not vary in a given display due to age, temperature or power supply. In such circumstance, such displays can be factory calibrated, which increases the manufacturing cost, but eliminates the need to include calibration system in each display, and thereby reduces the product cost.

BRIEF DESCRIPTION OF THE INVENTION

One of the objects of the invention is to provide improved testing and calibration apparatus that is external to an LCD system but which can be connected thereto to factory or field calibrate each display in accordance with the transmissivity characteristics of such display to obtain a maximum number of gray brightness levels for such display.

Another object of the invention is to provide test and calibration apparatus which can be connected to an LCD display system to initially measure the drain voltage versus transmissivity characteristics of such display, analyze the test results, and set PEl transmissivity controls to achieve a maximum number of brightness levels in accordance with test results.

Briefly, in accordance with the invention, a TFT LCD display has a PEL matrix in which the drain lines of the different TFTs are supplied with different drain voltages to achieve a plurality of gray scales. The different drain voltages are set by connecting a testing and calibration apparatus to the display system. Such apparatus measures the transmissivity characteristics during calibration through use of a hidden test PEL in the display, which has substantially the same characteristics as PELs viewable by a user. The measurement or test results are then analyzed by the apparatus and PEL controls in the display system are set with control values for achieving different gray scales.

BRIEF DESCRIPTION OF DRAWINGS

Other objects and advantages of the invention will be apparent from the following description taken in connection with the accompanying drawings wherein.

DETAILED DESCRIPTION OF INVENTION

Figure 1:
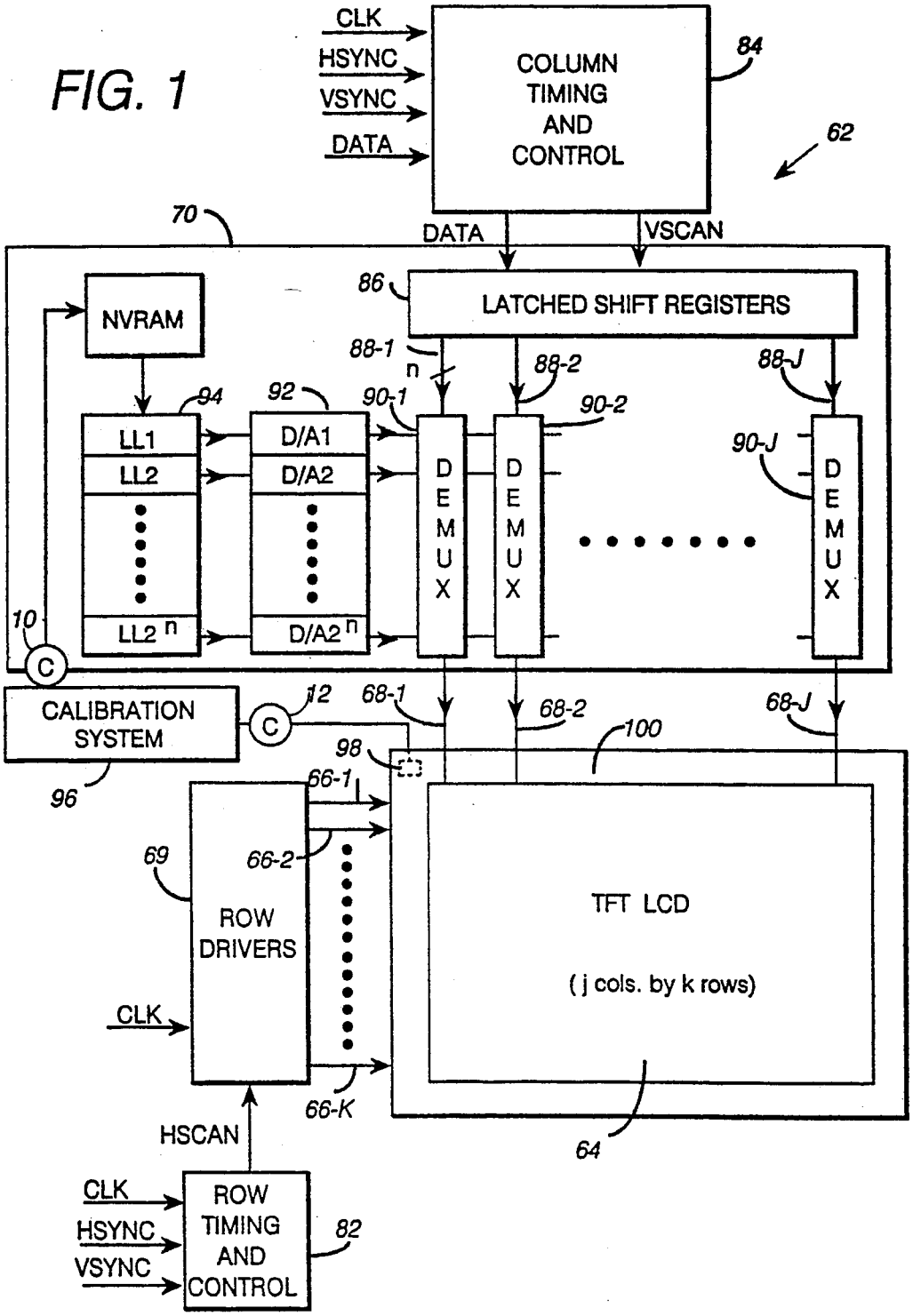
FIG. 1 is a block diagram of a calibration system connected to an LCD system, which embody the invention.

Referring now to the drawings, and first to FIG. 1, there is shown an exemplary LCD system 62 connected to a calibration system by connectors 10 and 12. LCD system 62 is suitable for use in a data processing system such as is disclosed in the above parent application. LCD system 62 comprises a TFT LCD 64 having a matrix of PELs arranged in "j" columns of "k" rows. A typical matrix has 640 columns and 480 rows. A plurality of gate lines 66-1 through **66-*k* are connected to the gates of all the PELS in the respective rows to supply gate signals to the rows of PELs. A plurality of drain lines 68-1 through 68-*j*** are connected to the drain lines of the respective PELS in the different columns to supply drain voltage signals to the columns of PELs.

Gate lines 66 are driven by row drivers 69 and drain lines 68 are driven by column drivers 70. An individual PEL is activated by the coincidence of a gate signal and a drain voltage signal or level on the gate line 66 and drain line 68 respectively connected to the individual PEL.

Row drivers 69 are constructed and operated in a conventional manner by a clock (CLK) signal and a horizontal scan (HSCAN) signal supplied thereto, the latter signal coming from row timing and control circuit 82. A CLK signal is supplied to circuit 82 along with a horizontal synchronizing (HSYNC) signal and a vertical synchronizing (VSYNC) signal. The latter two signals are also fed into a column timing and control circuit 84 along with a CLK signal and DATA signals. Such DATA signals include in each signal a digital value representing a gray scale level to be displayed on an individual PEL. Circuits 82 and 84 operate synchronously to repetitively and rapidly cause the gate signals and drain signals to be supplied to LCD 64 and thereby create a display of the desired data for viewing by a user.

Column drivers 70 comprises a plurality of latched shift registers 86 that receive a vertical scan (VSCAN) and DATA signals from circuits 84 and output onto a plurality of lines 88-1 through **88-*j* a series of digital control signals of "n" bits each. The number of bits "n" is chosen or predetermined in accordance with how many ($2^n$) gray scale or brightness levels are desired and obtainable within the display technology. Lines 88 are respectively connected to a plurality of demultiplexers (DEMUXes) 90-1 through 90-*j* which in turn have outputs respectively connected to drain lines 68**.

A plurality of $2^n$ level latches (LL) 94 have outputs respectively connected to inputs of a like plurality of digital to analog converters (D/A) 92. LL 94 are loaded during calibration, in a manner described below, with digital control signals representing brightness values defining $2^n$ different levels of drain voltages. Such control values are converted by D/A 92 into the actual $2^n$ different levels of analog drain voltages that are transmitted to DEMUXes 90. Each DEMUX is operative to drive one of the voltage levels present at the outputs of 92, onto the drain line 88 connected thereto so as to drive a PEL within the column which receives an active gate signal, to a brightness level dependent on the value of the DATA signal applied to such DEMUX. LL 94 are loaded with values transmitted from calibration system 96 during the calibration process as described in more detail hereinafter. LCD 64 also includes an opaque mask 100 surrounding the above described matrix of PELS, and a test PEL 98 is located behind the mask out of sight of a user. Test PEL 98 is formed at the same time as the viewable PELs and has the same characteristics so as to provide a reliable test object for accurately calibrating the display. The test PEL is used only during calibration and is not used during the normal operation of system 62 after calibration.

Figure 2:
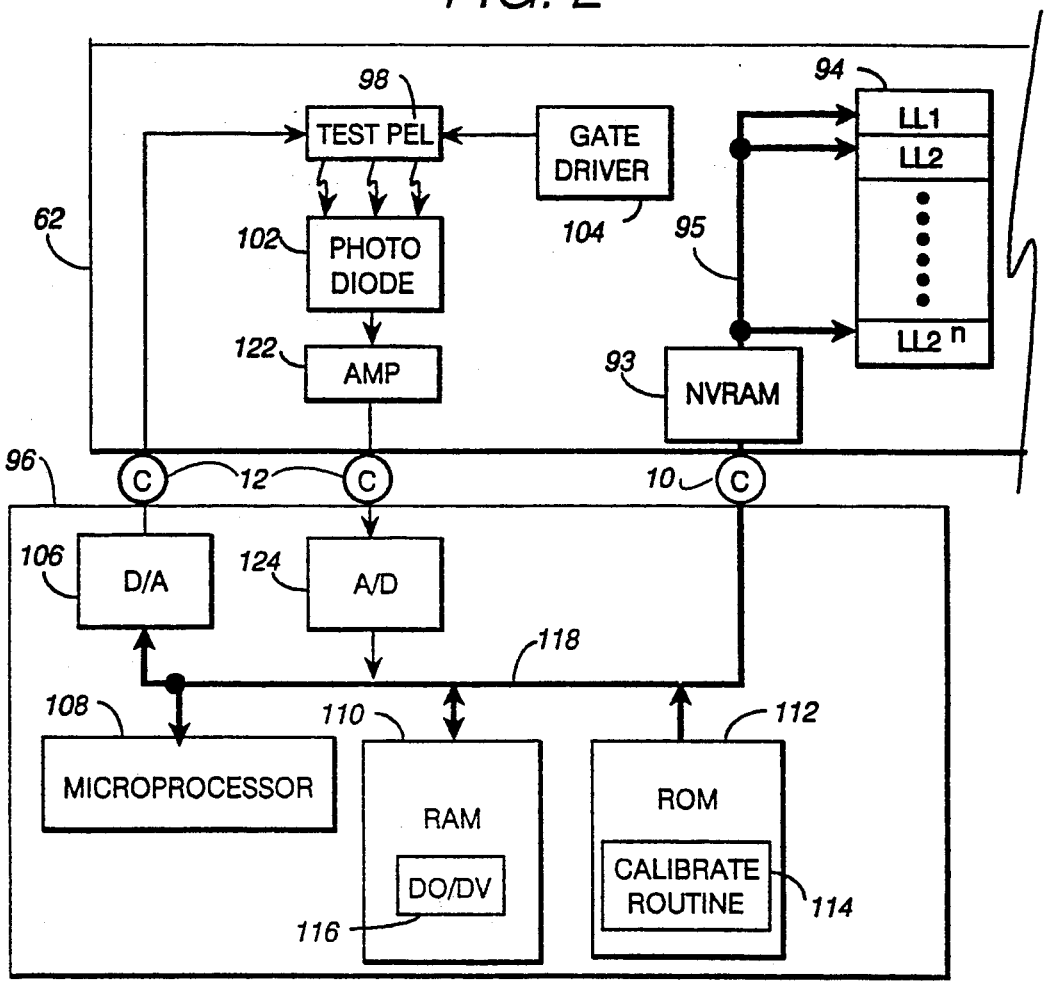
FIG. 2 is a block diagram showing details of the systems shown in FIG. 1.

With refernce to FIG. 2, LCD system 62 also includes a photodiode 102, an amplifier, a gate driver 104, and a nonvolatile random access memory 93, that are used during the calibration process when system 62 is connected to calibration system 96. Photodiode 102 is shaped and located next to the test PEL so as to receive light emitted by PEL 98 and produce an output voltage indicative of the brightness of such light. PEL 98 receives a gate signal from a gate driver 104 and drain signals from a D/A converter 106, during calibration. Converter 106 has the same conversion characteristics as those of converter 92 so that the analog output values thereof will be the same for a given digital input value. Gate driver 104 is a free running oscillator that matches the frequency and duty cycle of a viewable PEL. During calibration, the test PEL is driven at the same refresh frequency as is a viewable PEL to provide a direct correlation of the characteristics of the test PEL with those of the viewable PELs. When a given display is manufactured, it is expected that there might be some slight variations in the characteristics of the individual PELs therein. The use of a single test PEL should provide acceptable test accuracy, but it is within the scope of the invention to use plural test PELs and average the results to achieve greater accuracy.

Calibration system 96 further includes a digital data processing system having a microprocessor 108 connected by a bus 118 to a RAM 110, ROM 112, an analog-to-digital (A/D) converter 124, and a digital-to-analog converter (D/A) 106. ROM 112 stores a calibrate program or routine 114 which is selectively executable in microprocessor 108 to effect calibration. During calibration, the analog outputs (DO) of photodiode 102 are amplified in an amplifier 122 and then digitized in an analog-to-digital converter (A/D) 124 for transmission over bus 118 for storage in table 116. Table 116 also stores the digital test values (DV) that produced the respective analog values DO.

Figure 3:
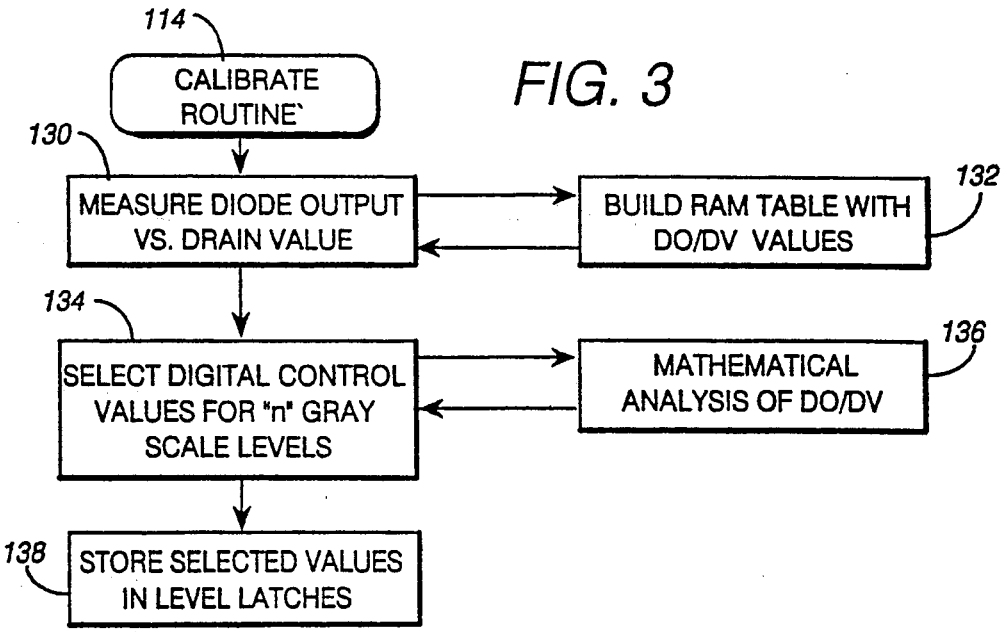
FIG. 3 is a general flow diagram of the testing and calibration process used in the invention.

Prior to the start of calibration, system 96 is connected to system 62 through analog connectors 12 and digital connector 10 which respectively connect D/A 106 and test PEL 98, amplifier 122 and A/D 124, and bus 118 and NVRAM 93. Then, the systems are powered up and the calibrate routine is executed. Referring to FIG. 3, when calibration routine 114 is executed by processor 108, step 130 measures the output voltage of photodiode 102 as a function of a series of test drain voltage values applied to test PEL 98. Such measurement entails building table 116 in RAM 114 and storing values for the test drain voltages DV versus photodiode output DO. The number of test values or samples taken during the test is greater (e.g., by a factor of 100) than the number of levels of gray values which is predetermined for a given display system. This optimizes the intensity of gray shades.

Next, step 134 then selects the different control values to be loaded into LL 94 to produce "n" gray scale levels of drain voltages, the selection being determined by step 136 in which a mathematical analysis is made of the photodiode output versus test drain voltage inputs into PEL 98. Such analysis is preferably made using either one of the following two formulas or equations:

$$X(y+1)=X(y)*\sqrt{2} \qquad \text{(Egn. 1)}$$

where

X(y+1)=diode output for the (y+1) level of gray scale,

X(y)=diode output for the (y) level of gray scale level but where X(1) is the minimum diode output detected during the test, y is a value ranging from 1 to "n", and "n" is the number of gray scale levels.

The number n=ln(CR)/((ln 2)/2) where "CR" is the contrast ratio and "ln" is the standard natural log with "n" being rounded down to the nearest integer.

$$x(y+1)=X(y)*e^{Ln\ Cr/n} \qquad \text{(Eqn. 2)}$$

where e=natural log base, and all other terms are as previously defined.

The use of Eqn. 1 produces a gray scale step ratio of approximately 1.4 which is considered to be the minimum ratio for a human to distinguish between adjacent brightness or gray scale levels. The use of Eqn. 2 produces a step ratio greater than 1.4 so that the resultant displays look "snappier" and have more distinguishable contrasts between adjacent levels. Once the diode step levels have been determined, table 118 is then accessed to lookup the DV values which produced such levels, and step 138 then stores the selected digital values as digital control values in NVRAM 93. During normal operation after completion of calibration, when LCD system 62 is first turned on,the various levels of drain line voltages are loaded into LLs 94 from NVRAM 93 and are then applied to the viewable PELs repetitively as fixed width pulses by pulse amplitude modulation to produce the different gray scales.

While the foregoing detailed calibration process is described relative to a monochromatic LCD, it should be obvious to those skilled in the art that the procedure can be applied to colored LCDs by calibrating the red, green and blue (R,G, and B) liquid crystals in a similar manner, and that calibration could also be done in the field or at a repair facility and is not limited to use in amnufacturing facility. It should also be apparent to those skilled in the art that other changes can be made in the details and arrangements of steps and parts without departing from the scope of the invention as defined in the appended claims.

What is claimed is:

1. A thin film transistor (TFT) liquid crystal display (LCD) and calibration apparatus therefor, comprising:

connector means for selectively connecting and disconnecting said LCD to and from said calibration apparatus, said LCD having having a run mode of operation when disconnected from said calibration apparatus and a calibration mode of operation when connected to said calibration apparatus; said LCD comprising a matrix of viewable picture elements (PELs), each PEL comprising liquid crystal material coupled with a TFT and operative to transmit light to a degree controllable by a drain voltage applied to such TFT, a plurality of N digitally controlled voltage sources connected to said matrix for supplying different levels of drain voltages to said viewable PELs to produce, in said viewable PELs, N different gray scale levels, each voltage source comprising a register for storing a digital voltage value establishing the value of drain voltage to be produced by said each voltage source, and a digital-to-analog converter connected to said register for converting said digital voltage value stored in said register into an analog value of drain voltage, a non-volatile random address memory (NVRAM) connected to said voltage sources, said NVRAM having a plurality of storage positions for storing N digital voltage values for controlling said voltage sources, control means connected to said voltage sources and to said viewable PELs for controlling which voltage source supplies a drain voltage to each viewable PEL, a test PEL having characteristics substantially the same as those of said viewable PELs, said test PEL comprising a gate line and a drain line, a photodiode positioned adjacent said test PEL for measuring light transmitted therethrough and producing an output signal proportional thereto, a test digital-to-analog converter (DAC) connected to said drain line of said test PEL for applying drain voltage test signals to said test PEL, said test DAC having characteristics the same as the characteristics of said digital-to-analog converters in said voltage sources, a gate driver connected to said gate line of said test PEL and operative to generate gate signals concurrent with said drain voltage test signals, and means, including an analog-to-digital converter-(ADC), connected to said photodiode and to said DPS for converting analog output signals from said photodiode into digital output values (DOs);

said calibration apparatus being connected to said ADC and to said NVRAM, when said calibration apparatus is connected to said LCD, for measuring said characteristics of said test PEL and storing N different digital voltage values in said NVRAM to thereby provide N gray scale levels for said viewable PELs, said calibration apparatus being operative during said calibration mode and comprising a digital data processing system (DPS) including a processor, and a main memory connected to said processor for storing a calibration routine and measurement results;

said DPS being operative, in response to execution of said calibration routine by said processor during said calibration mode, to measure characteristics of said test PEL by storing in said main memory a test series of different digital drain voltage test signals (DVs) and transmitting said DVs to said test DAC to thereby actuate said test PEL and said ADC to produce said DOs, said series of DVs encompassing a range extending from minimum transmissivity of said test PEL to maximum transmissivity of said test PEL and including a plurality of test signals that greatly exceeds the number of gray scale levels, and by receiving said DOs from said ADC and storing said DOs in said main memory at locations corresponding to the respective ones of said DVs which produced said DOs; and said DPS being further operative in response to execution of said calibration routine by said processor to analyze said signals stored in said main memory, locate N ascending values of DOs where each higher DO so located differs from a lower preceding value by a ratio of at least 1.4, where N is determined from the relationship $N=\ln(CR)/((\ln 2)/2)$, and CR=(maximum transmissivity/minimum transmissivity) of said test PEL, N being rounded down to nearest integer, and store in said NVRAM the ones of DVs corresponding to the N values of ascending DOs so located.

2. Apparatus in accordance with claim 1 wherein said LCD is operative, when disconnected from said calibration apparatus and in response to being powered up, to copy said digital values in said NVRAM into said registers of said voltage sources.

3. Apparatus in accordance with claim 2 wherein said viewable PELs in said matrix are arranged in rows and columns, and said LCD system further comprises:

a plurality of demultiplexers having outputs connected to drive lines of said viewable PELs and inputs connected to said variable voltage sources and to a source of data signals each of which contains a gray scale value for a given PEL whereby such gray scale value determines which drain voltage level is applied to such given PEL.

4. Apparatus in accordance with claim 3 wherein said source of data signals comprises a video random access memory (VRAM) for storing said data signals.

5. Apparatus in accordance with claim 4 comprising:

timing means connected to said VRAM for receiving said data signals therefrom and controlling drain voltage signals applied to said PELs so as to repetitively refresh each PEL for a predetermined fixed duration each time a drain voltage level is applied to each PEL.

6. Apparatus in accordance with claim 2 wherein said ratio equals $e^{Ln\ CR/N}$ where e=natural log base.

7. Apparatus in accordance with claim 2 wherein said source of data signals comprises a video random access memory (VRAM) for storing said data signals.

8. Apparatus in accordance with claim 7 comprising timing means connected to said VRAM for receiving said data signals therefrom and controlling drain voltage signals applied to said PELs so as to repetitively refresh each PEL for a predetermined fixed duration each time a drain voltage level is applied to each PEL.

* * * * *